United States Patent [19]

Cha

[11] 4,126,180

[45] Nov. 21, 1978

[54] METHOD OF ENHANCING YIELD FROM AN IN SITU OIL SHALE RETORT

[75] Inventor: Chang Y. Cha, Bakersfield, Calif.

[73] Assignee: Occidental Oil Shale, Inc., Grand Junction, Colo.

[21] Appl. No.: 805,975

[22] Filed: Jun. 13, 1977

Related U.S. Application Data

[63] Continuation-in-part of Ser. No. 714,345, Aug. 16, 1976, abandoned, which is a continuation of Ser. No. 634,430, Nov. 24, 1975, abandoned, which is a continuation of Ser. No. 492,290, Jul. 26, 1974, abandoned.

[51] Int. Cl.[2] ..... E21B 43/24

[52] U.S. Cl. ..... 166/261; 166/259; 48/197 R; 208/11 R; 208/11 LE; 299/2

[58] Field of Search ..... 166/261, 259, 260, 256, 166/258, 247, 272, 303; 48/89, 107, 197 R, 212, DIG. 6; 299/2-5; 208/11

[56] References Cited

U.S. PATENT DOCUMENTS

| | | | |
|---|---|---|---|
| 3,342,257 | 9/1967 | Jacobs et al. | 166/259 UX |
| 3,454,958 | 7/1969 | Parker | 166/256 |
| 3,460,620 | 8/1969 | Parker | 166/247 UX |
| 3,499,489 | 3/1970 | Parker | 166/258 |
| 3,521,709 | 7/1970 | Needham | 166/259 X |
| 3,537,528 | 11/1970 | Herce et al. | 166/261 X |
| 3,548,938 | 12/1970 | Parker | 166/256 |
| 3,586,377 | 6/1971 | Ellington | 299/4 |

*Primary Examiner*—Stephen J. Novosad
*Attorney, Agent, or Firm*—Christie, Parker & Hale

[57] ABSTRACT

To recover liquid and gaseous products from a fragmented permeable mass of particles containing oil shale, a buffer zone containing retorted oil shale is established in the fragmented mass by passing a hot processing gas substantially free of free oxygen through at least a portion of the fragmented mass. Thereafter, a combustion zone is established in the buffer zone, and a combustion zone feed containing oxygen is introduced into the fragmented mass on the trailing side of the combustion zone. This advances the combustion zone through the fragmented mass and retorts oil shale in a retorting zone on the advancing side of the combustion zone. The thickness of the buffer zone is sufficient for reaction of most of the oxygen in the combustion zone feed with residual carbonaceous material in retorted oil shale in the buffer zone.

29 Claims, 3 Drawing Figures

METHOD OF ENHANCING YIELD FROM AN IN SITU OIL SHALE RETORT

CROSS-REFERENCES

Figure 1:
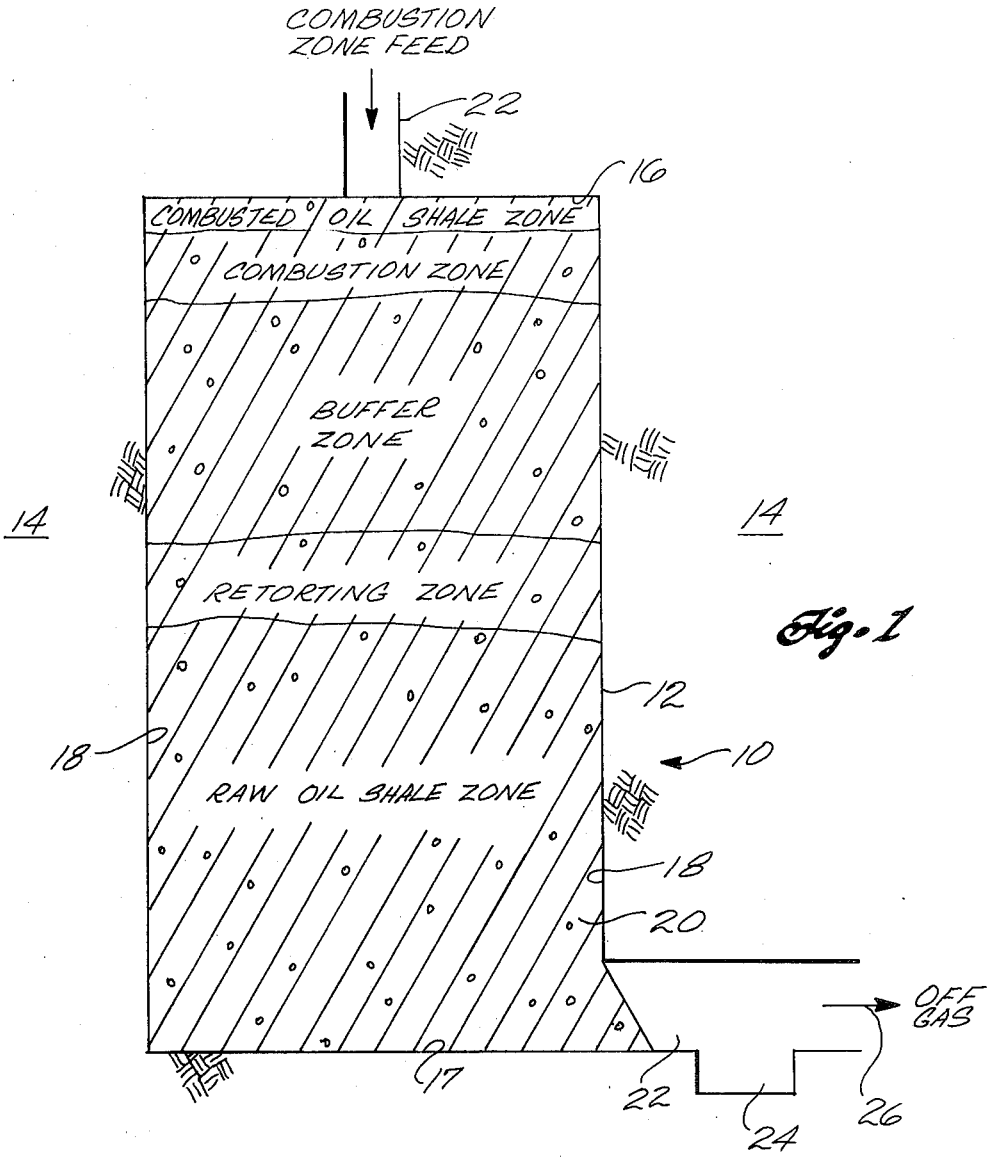

This application is a continuation-in-part of U.S. patent application Ser. No. 714,345 filed on Aug. 16, 1976, now abandoned, which is a continuation application of U.S. patent application Ser. No. 634,430 filed Nov. 24, 1975, and now abandoned, which is a continuation application of U.S. patent application Ser. No. 492,290 filed on July 26, 1974, and now abandoned. Each of these patent applications is incorporated herein by this reference.

BACKGROUND

The presence of large deposits of oil shale in the Rocky mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which upon heating decomposes to produce hydrocarbon liquid and gaseous products. It is the formation containing kerogen that is called "oil shale" herein, and the liquid hydrocarbon product is called "shale oil".

A number of methods have been proposed for processing the oil shale which involve either first mining the kerogen bearing shale and processing the shale above ground, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by reference. This patent describes in situ recovery of liquid and gaseous hydrocarbon materials from a subterranean formation containing oil shale by mining out a portion of the subterranean formation and then fragmenting and expanding a portion of the remaining formation to form a fragmented, stationary, permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of a combustion zone feed containing oxygen downwardly into the combustion zone to advance the combustion zone downwardly through the retort. The combustion zone feed can contain steam provided by a steam generator to improve efficiency of retorting. In the combustion zone oxygen in the combustion zone feed is depleted by reaction with hot carbonaceous materials to produce heat and combustion gas. By the continued introduction of the oxygen supplying combustion zone feed downwardly into the combustion zone, the combustion zone is advanced downwardly through the retort.

The effluent gas from the combustion zone comprises combustion gas and any gaseous portion of the combustion zone feed that does not take part in the combustion process. This effluent gas passes through the retort on the advancing side of the combustion zone to heat the oil shale in a retorting zone to a temperature sufficient to produce kerogen decomposition, called retorting, in the oil shale to gaseous and liquid hydrocarbon products and retorted oil shale containing residual solid carbonaceous material.

The liquid products and gaseous products are cooled by cooler oil shale fragments in the retort on the advancing side of the retorting zone. An off gas containing combustion gas generated in the combustion zone, product gas produced in the retorting zone, gas from carbonate decomposition, and any gaseous combustion zone feed that does not take part in the combustion process is withdrawn to the surface. Liquid hydrocarbon products, together with water produced in or added to the retort, are also withdrawn to the surface as a liquid product stream through an access tunnel, drift or shaft.

During the retorting process, oxygen in the combustion zone feed can pass into the retorting zone, resulting in oxidation of hydrocarbon products produced in the retorting zone. This has the undesirable result of reducing hydrocarbon yield.

Therefore, there is a need for a process for retorting oil shale which minimizes oxidation of hydrocarbon products produced during retorting.

SUMMARY

This invention concerns a method for recovering liquid and gaseous products from an in situ oil shale retort in a subterranean formation containing oil shale, where the in situ retort contains a fragmented permeable mass of formation particles containing oil shale. According to this method, a buffer zone of hot retorted oil shale containing residual carbonaceous material is established in the fragmented permeable mass by passing a hot processing gas through at least a portion of the fragmented permeable mass. The hot processing gas is substantially free of free oxygen and has a temperature at least as high as the retorting temperature of oil shale in the fragmented mass.

Thereafter, a combustion zone advancing through the fragmented permeable mass is established in the buffer zone. A combustion zone feed containing oxygen is introduced into the fragmented mass on the trailing side of the combustion zone for reaction with residual carbonaceous material in retorted oil shale in the buffer zone. This advances the combustion zone through the fragmented mass and retorts oil shale to liquid and gaseous products in a retorting zone on the advancing side of the combustion and buffer zones.

The thickness of the buffer zone is sufficient for reaction of most, and preferably at least 80%, of the oxygen in the combustion zone feed with residual carbonaceous material in retorted oil shale in the buffer zone. With such a buffer zone, oxidation of hydrocarbon products produced in the retorting zone is minimized.

The hot processing gas can be generated by burning a fuel. The fuel, which can be burned in the fragmented permeable mass containing the buffer zone, can be in a fuel containing gas. A fuel containing gas can be generated by introducing an oxygen containing gas into a second fragmented permeable mass of formation particles containing hot retorted oil shale.

DRAWINGS

Figure 2:
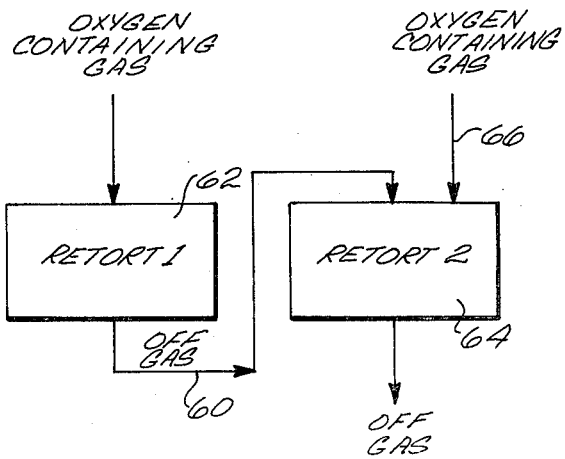
Figure 3:
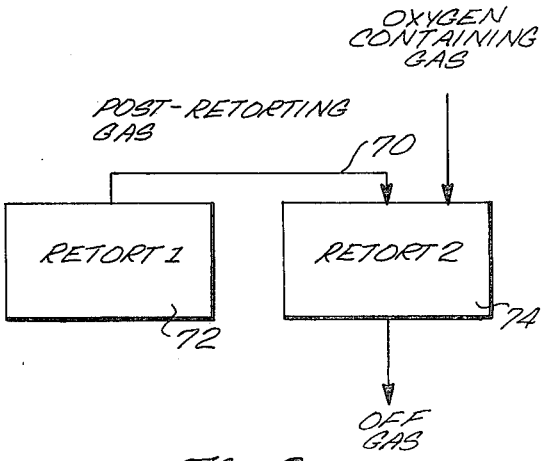

These and other features, aspects and advantages of the present invention will become more apparent with respect to the following description of the invention, appended claims, and accompanying drawings where:

FIG. 1 is a schematic representation of a vertical cross-section of an in situ oil shale retort;

FIG. 2 schematically represents a process embodying features of this invention, and FIG. 3 schematically represents another process embodying features of this invention.

DESCRIPTION OF THE INVENTION

Referring to FIG. 1, an in situ oil shale retort 10 is in the form of a cavity 12 formed in an unfragmented subterranean formation 14 containing oil shale and having top 16, bottom 17, and side boundaries 18 of unfragmented formation. The cavity 12 contains a fragmented permeable mass 20 of formation particles containing oil shale. The cavity 12 can be created simultaneously with fragmentation of the mass 20 of formation particles by blasting by any of a variety of techniques. A desirable technique involves excavating one or more voids within an in situ oil shale retort site and explosively expanding remaining oil shale in the site toward such a void. A method of forming an in situ oil retort is described in U.S. Pat. No. 3,661,423. A variety of other techniques can also be used.

Sufficient formation is excavated in the retort site that the void fraction of the permeable mass is from about 10 to about 25%. As used herein, "void fraction" refers to the ratio of the volume of the voids or spaces between particles in the fragmented mass to the total volume of the fragmented permeable mass of particles in the in situ retort 10.

One or more conduits 22 communicate with the top of the fragmented mass 20 of formation particles. According to the present invention, to recover liquid and gaseous products from the retort 10, a buffer zone of substantial thickness containing hot retorted oil shale containing residual carbonaceous material is established in the fragmented mass. This is effected by passing through at least a portion of the fragmented mass a hot processing gas. The hot processing gas is introduced to the top of the fragmented mass via the conduit 22.

As used herein, the term "hot processing gas" refers to a gas substantially free of free oxygen and having a temperature at least as high as the retorting temperature of oil shale in the fragmented mass. Retorting of oil shale occurs at temperatures up to about 800° F. and higher.

As used herein, the term "hot retorted oil shale " refers to retorted oil shale containing residual carbonaceous material, wherein the oil shale is at a temperture at least as high as the spontaneous ignition temperature of the residual carbonaceous material contained therein.

The hot processing gas retorts oil shale in a retorting zone on the advancing side of the buffer zone to yield gaseous and liquid hydrocarbon products. Oil shale on the advancing side of the retorting zone remains unretorted. The thickness of the retorting zone formed by the hot processing gas depends upon several factors such as the particle size distribution of the fragmented permeable mass and the rate of heat input into the retort by the processing gas. Because the hot processing gas is substantially free of free oxygen, burning of gaseous and liquid hydrocarbon products produced by retorting kerogen in the retorting zone does not occur.

After the buffer zone is established, a combustion zone advancing through the fragmented permeable mass is established. To establish the combustion zone, residual carbonaceous material in retorted oil shale in the buffer zone is ignited by any known method as, for example, the method described in U.S. Pat. No. 4,027,917, incorporated herein by this reference.

In a preferred method of establishing a combustion zone in the fragmented permeable mass 20, the hot retorted oil shale in the buffer zone has a temperature at least as high as the spontaneous ignition temperature of the residual carbonaceous material contained therein. Then, merely by introducing an oxygen containing gas into the buffer zone, a combustion zone can be established.

The spontaneous ignition temperature of the residual carbonaceous material is dependent upon the conditions at which the retorted oil shale in the buffer zone is contacted by oxygen containing gas, i.e. the spontaneous ignition temperature of residual carbonaceous material is dependent upon such process parameters as the total pressure and the partial pressure of oxygen in the fragmented mass.

The combustion zone is advanced through the fragmented permeable mass by introducing a combustion zone feed containing oxygen into the in situ oil shale retort through the conduit 22 in the same direction as the processing gas was introduced into the fragmented mass.

The combustion zone feed can be air or composition variations of air. For example, air can be augmented with additional oxygen so that the partial pressure of oxygen in the combustion zone feed is increased. Similarly, air can be diluted with steam or recycled off gas from an in situ oil shale retort for reducing the partial pressure of oxygen. Such dilution, for example, is practiced for reducing the oxygen concentration of the combustion zone feed into the retort to about 14% instead of the 20% present in ambient air.

Oxygen from the combustion zone feed introduced to the retort reacts with residual carbonaceous material in retorted oil shale in the buffer zone to produce combustion gas and combusted oil shale. Heat from the exothermic oxidation reactions, carried by flowing gases, advances the combustion zone through the fragmented mass of particles.

A retorting gas comprising combustion gas produced in the combustion zone and any gaseous unreacted portion of the combustion zone feed passes through the fragmented mass of particles on the advancing side of the combustion zone to establish a retorting zone on the advancing side of the combustion zone. Kerogen in the oil shale is retorted in the retorting zone to produce liquid and gaseous products and retorted oil shale containing residual carbonaceous material.

As used herein, the term "retorted oil shale" refers to oil shale heated to sufficient temperature to decompose kerogen in an environment substantially free of free oxygen so as to leave a solid carbonaceous residue. The term "combusted oil shale" refers to oil shale of reduced carbon content due to oxidation by a gas containing free oxygen. An individual particle containing oil shale can have a core of retorted oil shale and an outer "shell" of combustion oil shale. Such can occur when oxygen has diffused only part way through the particle during the time it is at an elevated temperature and in contact with an oxygen containing gas. "Treated oil shale" refers to oil shale treated to remove organic materials and includes retorted and/or combusted oil shale. As used herein, the term "raw oil shale" refers to oil shale which has not been subjected to processing for decomposing kerogen in the oil shale.

The buffer zone established by passing a processing gas through the retort prior to establishment of the combustion zone has sufficient thickness that most of the oxygen in the combustion zone feed is reacted with residual carbonaceous material in retorted oil shale in the buffer zone. Thus, the retorting gas contains little, if any, oxygen. Therefore, reaction of liquid and gaseous hydrocarbon products of retorting with oxygen in the combustion zone feed is minimized, resulting in enhanced hydrocarbon yields.

There is an access tunnel, adit, drift 22 or the like in communication with the bottom of the retort. The drift contains a sump 24 in which liquid products are collected to be withdrawn for further processing. An off gas 26 containing products, combustion gas, gas from carbonate decomposition, and any gaseous unreacted portion of the combustion zone feed is also withdrawn from the in situ oil shale retort 10 by way of the drift 22. At the end of retorting, oil shale in the retort can contain appreciable amounts of residual carbonaceous material.

As shown in FIG. 1, according to the method of this invention, there are five zones in an in situ oil shale retort being processed. From top to bottom these zones are a combusted oil shale zone, a combustion zone, a buffer zone, a retorting zone, and a raw oil shale zone.

The combusted oil shale zone is the portion of the retort containing combusted oil shale and is on the trailing side of the combustion zone. The combustion zone is the portion of the retort where the greater part of the oxygen in the combustion zone feed that reacts with residual carbonaceous material in retorted oil shale is consumed. The buffer zone, which is on the advancing side of the combustion zone, contains retorted oil shale and is established by passing a hot processing gas through at least a portion of the fragmented permeable mass 20 in the retort 10. The retorting zone, which is on the advancing side of the combustion zone, is the portion of the retort where kerogen in oil shale is being decomposed to liquid and gaseous products. The raw oil shale zone, which is on the advancing side of the retorting zone, contains oil shale which has not been subjected to any processing for decomposing kerogen in the oil shale.

The thickness of the buffer zone of hot retorted oil shale that is established is selected so that most of the oxygen in the combustion zone feed reacts with residual carbonaceous material in the retorted oil shale in the buffer zone. By thus depleting most of the oxygen from the combustion zone feed, combustion of liquid and gaseous hydrocarbon products produced by retorting oil shale is substantially reduced or eliminated. Heat for continual retorting of oil shale in the retorting zone is obtained partially by transfer of sensible heat from formation particles in the buffer zone near the top of the retort and partially by combustion of residual carbonaceous material in hot retorted oil shale.

The thickness of the buffer zone of hot retorted oil shale in the trailing side of the retorting zone for depleting most of the oxygen from the combustion zone feed and thereby assuring that the retorting gas is substantially free of free oxygen depends upon a number of factors. One of these factors is the size of the particles in the fragmented mass. Carbonaceous residue adjacent the surfaces of the particles reacts first and can be quickly depleted. Thereafter, the reaction is at least partly limited by diffusion of material through such particles. As the size of the particles increase, the longer it takes for oxygen in the combustion zone feed to diffuse into the particles for reaction with residual carbonaceous material. Therefore, the larger the average size of particles in the fragmented permeable mass, the thicker the buffer zone need be.

Another factor influencing the thickness of the buffer zone is the oxygen concentration of the combustion zone feed. The lower the oxygen concentration of the combustion zone feed, the thinner the buffer zone required since less oxygen needs to be depleted before the retorting zone is reached.

Another factor in determining the thickness of the buffer zone is the original kerogen content of the oil shale. As the kerogen content of the oil shale increases, the greater the amount of residual carbonaceous material in retorted oil shale, and the easier it is for oxygen in the combustion zone feed to react with residual carbonaceous material before reaching the retorting zone. Use of the method of this invention for retorting oil shale having a Fischer Assay of less than about 10 gallons of shale oil per ton of oil shale is essentially infeasible because of the very thick buffer zone which would be required.

Another factor influencing the thickness of the buffer zone of hot retorted oil shale is the temperature of the buffer zone. This is because the temperature of retorted oil shale particles influences the diffusion rate of gases through oil shale particles, reaction rates, and under some conditions, the molecular species present in the buffer zone.

The composition of the combustion zone feed also affects the thickness of the buffer zone. For example, water vapor present in the combustion zone feed can diffuse into retorted oil shale particles and react therein with residual carbonaceous material to produce hydrogen and carbon monoxide by the water-gas reaction. The hydrogen and carbon monoxide can diffuse out of the retorted oil shale particles and then react with oxygen in the combustion zone feed. Since water vapor diffuses into retorted oil shale at a faster rate than oxygen, the presence of water vapor in the combustion zone feed results in faster consumption of residual carbonaceous material and faster depletion of oxygen in the buffer zone. Therefore, a thinner buffer zone is required.

Another factor in determining the thickness of the buffer zone is the mass flow rate of the combustion zone feed per square foot of retort area. As the mass flow rate increases, a thicker buffer zone is required, because the residence time of oxygen per foot of thickness of the buffer zone decreases.

Since determination of the thickness of the buffer zone depends upon so many interrelated factors, there is no single arbitrary suitable for depleting oxygen present in the combustion zone feed which is suitable for all situations. However, the desired length of the buffer zone can be estimated from the above mentioned parameters. Also, sampling probes for sampling the oxygen concentration of gases passing through the fragmented permeable mass can be placed in the mass through bore holes to experimentally determine when the buffer zone is sufficiently thick.

Even when the buffer zone of hot retorted oil shale has a considerable length, some oxygen in the combustion zone feed can still reach the retorting zone and react with hydrocarbons present therein. This is the case because even a very thick buffer zone cannot deplete one hundred percent of the oxygen in the combustion zone feed introduced into the retort. For example, it has been noted that oxygen is found in low concentrations in off gas withdrawn from a retort containing both a retorting zone and a combustion zone.

To minimize oxidation of hydrocarbon products of retorting of oil shale, preferably the thickness of the buffer zone is sufficient that at least 80% of the oxygen in the combustion zone feed is reacted in the buffer zone. That is, when air is used as the combustion zone feed, preferably the oxygen partial pressure in the retorting zone is less than about 35 millibars at the altitude at which oil shale deposits are found in the Western United States.

To deplete at least 80% of the oxygen in the combustion zone feed, preferably a hot processing gas is passed through the fragmented permeable mass for a sufficient time to establish a buffer zone of hot retorted oil shale having a thickness of at least about 40 feet. In a retort having such a buffer zone, and containing oil shale having a weight average particle size of about 1 inch and having an average Fischer Assay of about 25 gallons per ton with a gas flow rate of about 2 SCFM (standard cubic feet per minute) per square foot of retort area and a combustion zone feed containing about 12% oxygen, almost 90% of the oxygen in the combustion zone feed is depleted before reaching the retorting zone. Shorter lengths of the buffer zone deplete less of the oxygen.

The processing gas, because it is substantially free of free oxygen, is inert insofar as combustion of kerogen in the oil shale and hydrocarbon products of retorting of oil shale is concerned. That is, the hot processing gas does not burn shale oil or other hydrocarbon products of kerogen decomposition to any appreciable extent.

The processing gas can be a hot inert gas such as hot nitrogen, which can be generated by direct or indirect heating of an inert gas. The hot processing gas can be generated by oxidation of a solid, liquid, or gaseous fuel. Exemplary of suitable solid fuels are coal, wood chips, peat, high grade oil shale, and combinations thereof. Exemplary of suitable liquid fuels are crude petroleum oil, shale oil, diesel oil, and combinations thereof. Both solid and liquid fuels can be used simultaneously. For example, an absorbent, solid combustible material such as peat can be soaked with a liquid fuel such as shale oil.

Exemplary of suitable gaseous fuels are natural gas, liquefied petroleum gas, off gas from an active in situ oil shale retort, post-retorting gas from an in situ oil shale retort, or combinations thereof. As used herein, the terms "gaseous fuel", "gas containing fuel values", and "fuel containing gas" all refer to a gas at least a portion of which is combustible.

For economy of operation, it is preferred that the processing gas be obtained from another in situ oil shale retort, either as off gas or post-retorting gas. The use of off gas and post-retorting gas is more fully described below.

The fuel can be burned outside the fragmented permeable mass and the hot gas resulting therefrom can be introduced into the fragmented permeable mass to establish a buffer zone. Preferably the fuel is burned within the fragmented permeable mass for efficient utilization of the heat generated by combustion of the fuel.

In the case of a solid fuel, or a solid fuel soaked in a liquid fuel, the fuel can be placed into a void within the fragmented permeable mass, ignited, and then an oxygen containing gas such as air can be introduced to the retort for oxidation of the fuel and generation of the hot processing gas.

In the case of a liquid fuel, the fuel can be atomized and carried by a gas stream containing oxygen into the fragmented mass for combustion therein. Alternately, the liquid fuel can be sprayed into the fragmented mass and contacted within the fragmented mass by an oxygen containing gas such as air.

In the case of a gaseous fuel, the gaseous fuel can be combined with an oxygen containing gas either above ground or within the fragmented permeable mass for oxidation of the fuel and generation of the processing gas.

As used herein, "oxygen containing gas" refers to a gas containing free oxygen. It can be air, pure oxygen, compositional variations of air such as air enriched with pure oxygen or diluted with a gas such as steam or nitrogen, and combinations thereof.

Referring to FIG. 2, off gas 60 from a first in situ oil shale retort 62 containing a fragmented permeable mass of formation particles can be used for generating a hot processing gas for introduction into a second in situ oil shale retort 64. Such off gas can have a heating value of from about 20 to about 100 BTU/SCF (British thermal units per standard cubic foot), and often in the order of about 50 BTU/SCF. The heating value of such off gas can be increased by combining the off gas with a gaseous fuel such as natural gas to insure combustion of the off gas for generating hot processing gas. Off gas from an in situ oil shale retort is inert insofar as combustion of kerogen and oxidation of hydrocarbon products of retorting are concerned. Off gas can be, and in fact usually is, reducing in nature.

At the end of retorting operations, at least a portion of the oil shale in the retort 10 is at an elevated temperature which can be in excess of 1000° F. The hottest region of a retort is often near the bottom, and a somewhat cooler region is at the top due to continual cooling by gaseous combustion zone feed during retorting and due to conduction of heat to adjacent shale. The oil shale in the retort gradually cools toward ambient temperature when retorting and combustion are complete.

The off gas generated towards the end of the retorting operations can be heated to a substantially elevated temperature because of the presence of a thick mass of hot retorted and combusted oil shale particles in the retort. Temperatures of 1000° F. or more can be reached by the off gas under some circumstances. Such off gas can be withdrawn from the first retort 62 and introduced into the fragmented permeable mass in the second retort 64 while the gas remains hot for establishing the buffer zone. With such hot off gas, it is not necessary, although it is preferable, to react the fuel values in the off gas with oxygen for generating the hot processing gas. This is done by introducing an oxygen containing gas 66 into the second retort along with the off gas from the first retort. It is preferred to oxidize the off gas because this utilizes both the heat of combustion and the sensible heat of the off gas.

The off gas can be conveyed from the bottom of the first retort to the top of the second retort 64 through an underground raise. Preferably the raise does not extend to above ground so that the length of the conduit is minimized. Conventional bulkheads, pipes, valves, blowers if needed, metering devices and the like can be used as required.

Referring to FIG. 3, post-retorting gas 70 withdrawn from a first in situ oil shale retort 72 containing a fragmented permeable mass containing formation particles can also be used for providing the hot processing gas for introduction into a second in situ oil shale retort 74 containing a fragmented permeable mass of formation particles. Fuel values contained in the post-retorting gas preferably are oxidized to utilize the heat of combustion of the post-retorting gas.

Post-retorting gas is gas generated during a post-retorting operation. As used herein, the term "post-retorting operation" refers to a period at the end of normal retorting operation; that is, it refers to a period after a retorting zone has advanced through substantially all of the fragmented permeable mass in the retort. Generation of post-retorting gas by a post-retorting operation is described in U.S. patent application Ser. No. 763,155 filed on Jan. 22, 1977, assigned to the assignee of this invention, and incorporated herein by this reference.

According to this patent application, during a post-retorting operation, the rate of gas introduction to the fragmented permeable mass in the first retort 72 is sufficiently reduced that the withdrawn gas has a heating value of at least about 50 BTU/SCF. During such post-retorting operation, heat transfer from hot retorted and combusted oil shale in the retort raises the temperature of unfragmented formation adjacent the fragmented mass in the retort and of unretorted particles containing oil shale within the fragmented mass, if any, to temperatures at which retorting of kerogen proceeds. This results in additional gaseous products withdrawn in the post-retorting gas from the fragmented mass. During such post-retorting operation, an oxygen containing gas can be introduced to the retort, but at a reduced rate as compared to the rate of gas introduction during normal retorting operations. Post-retorting gas can have a heating value of over 150 BTU/SCF.

Although limited versions of a method for increasing yield of shale oil from an in situ oil shale retort have been described and illustrated herein, many modifications and variations are possible. Thus, for example, introduction of a hot processing gas can be continued until a buffer zone of moderate thickness has been established. Thereafter, limited amounts of oxygen can be included in the gas introduced into the retort for reaction with residual carbonaceous material in retorted oil shale in the buffer zone, so long as most of the oxygen is depleted before reaching the retorting zone. In other words, there is a gradual transition between the two modes of operation when a processing gas substantially free of free oxygen is used to create the buffer zone and when a combustion zone feed containing oxygen is used to combine with residual carbonaceous material in the buffer zone.

In addition, although FIG. 1 shows a retort where the combustion and retorting zones are advancing downwardly through the retort, this invention is also useful for retorts where the combustion and retorting zones are advancing upwardly or transverse to the vertical.

Because of variations such as these, the spirit and scope of the appended claims should not necessarily be limited to the description of the preferred versions contained herein.

What is claimed is:

1. A method for recovering liquid and gaseous products from an in situ oil shale retort in a subterranean formation containing oil shale, said in situ retort containing a fragmented permeable mass of formation particles containing oil shale, comprising the steps of:

(a) establishing a buffer zone of hot retorted oil shale containing residual carbonaceous material in the fragmented permeable mass by passing through at least a portion of the fragmented permeable mass a hot processing gas substantially free of free oxygen and having a temperature at least as high as the retorting temperature of oil shale in the fragmented mass;

(b) thereafter establishing in the buffer zone a combustion zone advancing through the fragmented permeable mass; and (c) introducing a combustion zone feed containing oxygen into the fragmented mass on the trailing side of the combustion zone for reaction with residual carbonaceous material in retorted oil shale in the buffer zone to advance the combustion zone through the fragmented means and for retorting oil shale to liquid and gaseous products in a retorting zone on the advancing side of the combustion zone, wherein the thickness of the buffer zone is sufficient for reaction of most of the oxygen in the combustion zone feed with residual carbonaceous material in retorted oil shale in the buffer zone.

2. A method as claimed in claim 1 including the step of introducing an oxygen containing gas into a second fragmented permeable mass of formation particles containing hot retorted oil shale for generating the hot processing gas.

3. A method as claimed in claim 1 including the step of burning a fuel for generating the hot processing gas.

4. A method as claimed in claim 3 wherein the fuel is burned in the fragmented permeable mass containing the buffer zone.

5. A method as claimed in claim 4 including the steps of introducing an oxygen containing gas to a second fragmented permeable mass of formation particles containing hot retorted oil shale for generating a fuel containing gas and introducing such fuel containing gas into the first mentioned fragmented mass.

6. A method as claimed in claim 5 wherein the fuel containing gas generated in the second fragmented permeable mass is hot, and including the step of withdrawing such fuel containing gas from the second fragmented permeable mass while such fuel containing gas remains hot, and wherein such withdrawn fuel containing gas is burned while such withdrawn fuel containing gas remains hot.

7. A method as claimed in claim 1 wherein the hot processing gas is passed through the fragmented permeable mass for a sufficient time to establish a buffer zone of hot retorted oil shale having a thickeness of at least about 40 feet.

8. A method as claimed in claim 1 wherein the buffer zone is sufficiently thick that the partial pressure of oxygen in the retorting zone is less than about 35 millibars.

9. A method as claimed in claim 1 in which the retorting zone is on the advancing side of the buffer zone.

10. A method as claimed in claim 1 including the step of burning a fuel containing gas for generating the hot processing gas.

11. A method as claimed in claim 10 wherein the fuel containing gas is burned in the fragmented permeable mass containing the buffer zone.

12. A method as claimed in claim 10 including the steps of withdrawing post-retorting gas from a second fragmented permeable mass of formation particles containing hot treated oil shale and burning such post-retorting gas for generating the fuel containing gas.

13. A method for retorting oil shale in a subterranean formation containing oil shale comprising the steps of:

introducing an oxygen containing gas into a first in situ oil shale retort containing a fragmented permeable mass of formation particles containing retorted oil shale containing residual carbonaceous material for reaction with such carbonaceous material for generating an off gas substantially free of free oxygen;

withdrawing such off gas from the first retort;

introducing off gas withdrawn from the first retort into a second in situ oil shale retort containing a fragmented permeable mass of formation particles containing raw oil shale for a sufficient time to establish a buffer zone of hot retorted oil shale containing residual carbonaceous material in the fragmented permeable mass in the second retort, the hot retorted oil shale in the second retort having a temperature at least as high as the spontaneous ignition temperature of the residual carbonaceous material contained therein; and thereafter introducing an oxygen containing gas into the buffer zone for reaction with residual carbonaceous material in the hot retorted oil shale in the buffer zone and for retorting raw oil shale to liquid and gaseous products on the advancing side of the buffer zone, the buffer zone having a thickness sufficient for reacting most of the oxygen in the oxygen containing gas introduced into the buffer zone with residual carbonaceous material in the retorted oil shale in the buffer zone.

14. A method as claimed in claim 13 wherein the hot off gas contains fuel values, and including the step of reacting fuel values in the off gas with oxygen before introducing the off gas to the second in situ oil shale retort.

15. A method as claimed in claim 13 wherein the off gas contains fuel values, and including the step of reacting fuel values in the off gas with oxygen within the fragmented mass in the second retort.

16. A method for forming a retorting gas substantially free of free oxygen comprising the steps of:

introducing a processing gas having a temperature at least as high as the retorting temperature of oil shale and substantially free of free oxygen into a fragmented permeable mass of particles containing raw oil shale to form a buffer zone of hot retorted oil shale containing residual carbonaceous material in the fragmented mass;

thereafter establishing in the buffer zone a combustion zone advancing through the fragmented permeable mass; and introducing into the combustion zone in the same direction as the processing gas was introduced into the fragmented mass a combustion zone feed containing oxygen for reaction with carbonaceous material in the retorted oil shale in the buffer zone to generate a retorting gas passing out of the combustion zone on the advancing side of the combustion zone, wherein the buffer zone is sufficiently thick that most of the oxygen in the combustion zone feed is depleted so that the retorting gas is substantially free of free oxygen.

17. A method as claimed in claim 16 including the step of generating the processing gas by reacting a gas containing fuel values with oxygen.

18. A method as claimed in claim 17 in which the gas containing fuel values is reacted with oxygen in the fragmented permeable mass of particles containing oil shale.

19. A method for forming a retorting gas comprising the steps of:

introducing a processing gas having a temperature at least as high as the retorting temperature of oil shale and substantially free of free oxygen into a portion of a fragmented permeable mass of particles containing raw oil shale to form a buffer zone of hot retorted oil shale containing residual carbonaceous material in the fragmented mass;

thereafter establishing in the buffer zone a combustion zone advancing through the fragmented permeable mass; and introducing into the combustion zone in the same direction as the processing gas was introduced into the fragmented mass a combustion zone feed containing oxygen for reaction with carbonaceous material in the retorted oil shale in the buffer zone to generate a retorting gas passing out of the combustion zone on the advancing side of the combustion zone, wherein the buffer zone is sufficiently thick that the partial pressure of oxygen in the retorting gas is less than about 35 millibars.

20. A method as claimed in claim 19 including the step of generating the processing gas by reacting a gas containing fuel values with oxygen.

21. A method as claimed in claim 20 in which the gas containing fuel values is reacted with oxygen in the fragmented permeable mass of particles containing oil shale.

22. A method for recovering liquid and gaseous products from an in situ oil shale retort in a subterranean formation containing oil shale, said in situ retort containing a fragmented permeable mass of formation pratic-les containing oil shale, comprising the steps of:

(a) establishing a buffer zone of hot retorted oil shale containing residual carbonaceous material in the fragmented permeable mass by passing through at least a portion of the fragmented permeable mass a hot processing gas substantially free of free oxygen and having a temperature at least as high as the retorting temperature of oil shale in the fragmented mass;

(b) thereafter establishing in the buffer zone a combustion zone advancing through the fragmented permeable mass; and (c) introducing a combustion zone feed containing oxygen into the fragmented mass on the trailing side of the combustion zone for reaction with residual carbonaceous material in retorted oil shale in the buffer zone to advance the combustion zone through the fragmented mass and for retorting oil shale to liquid and gaseous products in a retorting zone on the advancing side of the combustion zone, wherein the thickness of the buffer zone is sufficient that at least 80% of the oxygen in the combustion zone feed is reacted in the buffer zone.

23. A method as claimed in claim 22 including the step of burning a fuel for generating the hot processing gas.

24. A method as claimed in claim 23 wherein the fuel is burned in the fragmented permeable mass containing the buffer zone.

25. A method as claimed in claim 22 in which the retorting zone is on the advancing side of the buffer zone.

26. A method as claimed in claim 22 including the step of burning a fuel containing gas for generating the hot processing gas.

27. A method as claimed in claim 26 including the steps of withdrawing post-retorting gas from a second fragmented permeable mass of formation particles containing hot treated oil shale and burning such post-retorting gas for generating the fuel containing gas.

28. A method for retorting oil shale in a subterranean formation containing oil shale comprising the steps of:

withdrawing a gas containing fuel values from a first in situ oil shale retort containing a fragmented permeable mass of formation particles containing hot retorted oil shale containing residual carbonaceous material;

reacting such gas containing fuel values with oxygen to generate a hot processing gas;

introducing such hot processing gas into a second in situ oil shale retort containing a fragmented permeable mass of formation particles containing raw oil shale for a sufficient time to generate a buffer zone of hot retorted oil shale containing residual carbonaceous material in the fragmented permeable mass in the second retort, the hot retorted oil shale in the second retort having a temperature at least as high as the spontaneous ignition temperature of the residual carbonaceous material containing therein; and thereafter introducing an oxygen containing gas into the buffer zone for reaction with residual carbonaceous material in the hot retorted oil shale in the buffer zone for retorting raw oil shale to liquid and gaseous products on the advancing side of the buffer zone, the buffer zone having a thickness sufficient for reacting most of the oxygen in the oxygen containing gas with residual carbonaceous material in the retorted oil shale in the buffer zone.

29. A method as claimed in claim 28 wherein the gas containing fuel values is reacted with oxygen in the fragmented permeable mass in the second retort.

* * * * *

UNITED STATES PATENT AND TRADEMARK OFFICE

CERTIFICATE OF CORRECTION

PATENT NO. : 4,126,180

DATED : November 21, 1978

INVENTOR(S) : Chang Yul Cha

It is certified that error appears in the above-identified patent and that said Letters Patent are hereby corrected as shown below:

Column 5, line 21, --gaseous-- should be inserted after "containing" and before "products".

Column 10, line 23, "means" should be -- mass --.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*